US008545170B2

(12) United States Patent
Sanchez

(10) Patent No.: US 8,545,170 B2
(45) Date of Patent: Oct. 1, 2013

(54) TURBO MACHINE EFFICIENCY EQUALIZER SYSTEM

(75) Inventor: Nestor Hernandez Sanchez, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 1009 days.

(21) Appl. No.: 12/606,530

(22) Filed: Oct. 27, 2009

(65) Prior Publication Data

US 2011/0097198 A1 Apr. 28, 2011

(51) Int. Cl.
*F01D 9/02* (2006.01)
*F01D 25/32* (2006.01)

(52) U.S. Cl.
USPC ..... 415/115

(58) Field of Classification Search
USPC ..... 415/115, 169.1, 191, 193, 202, 116
See application file for complete search history.

(56) References Cited

U.S. PATENT DOCUMENTS 3,051,438 A * 8/1962 Page et al. ..... 416/92
3,746,462 A * 7/1973 Fukuda ..... 415/115
5,167,486 A * 12/1992 Detanne ..... 415/115
5,634,766 A * 6/1997 Cunha et al. ..... 415/115
5,743,708 A * 4/1998 Cunha et al. ..... 415/115
6,007,296 A * 12/1999 Ernst et al. ..... 415/115
6,036,436 A * 3/2000 Fukuno et al. ..... 415/115
6,315,518 B1 * 11/2001 Uematsu et al. ..... 415/115
6,354,798 B1 3/2002 Deckers
6,585,479 B2 * 7/2003 Torrance ..... 415/58.5
7,264,445 B2 * 9/2007 Naik et al. ..... 416/97 R
8,152,445 B2 * 4/2012 Guemmer ..... 415/58.5
2006/0153673 A1 * 7/2006 Guemmer ..... 415/115

FOREIGN PATENT DOCUMENTS

JP 2005320876 A 11/2005

* cited by examiner

*Primary Examiner* — Nathaniel Wiehe
*Assistant Examiner* — Sean J Younger
(74) *Attorney, Agent, or Firm* — Hoffman Warnick LLC; Ernest G. Cusick

(57) ABSTRACT

A system for a turbo machine is provided, including one or more channels that redirect steam that leaks through the root and/or the tip regions of a stage of the turbine to mix with the high efficiency main steam flow at the pitch region of the turbine where efficiency is the highest. This redirection of the steam results in a significant performance improvement that evens out the efficiency profile resulting in higher average efficiencies.

8 Claims, 4 Drawing Sheets

TURBO MACHINE EFFICIENCY EQUALIZER SYSTEM

BACKGROUND OF THE INVENTION

The invention relates generally to turbo machines. More particularly, the invention relates to a turbo machine efficiency equalizer system.

The flow path efficiency in turbo machines is a result of a multiple loss parameters and their interaction, including parameters associated with aerodynamic and fluid flow losses. Currently, efforts have been made to understand and reduce those losses by improving blade profiles, reducing wall losses, gap losses and minimizing radial and circumferential efficiency variations. However, these proposed improvements do not adequately improve steampath efficiency.

The inherent flow path losses described above are the highest at the roots and tips of the turbo machine stage, because the operative fluid tends to leak through these areas. Therefore, the highest efficiency exists in the middle of the stage, and the lowest efficiency exists close to the root and the tip of the stage.

BRIEF DESCRIPTION OF THE INVENTION

A system for a turbo machine is provided, including one or more channels that redirect steam that leaks through the root and/or tip regions of a stage of the turbine to mix with the high efficiency main steam flow at the pitch region of the turbine where efficiency is the highest. This redirection of the steam results in a significant performance improvement that evens out the efficiency profile resulting in higher average efficiencies.

A first aspect of the invention provides a system for a turbo machine, the system comprising: a rotating vane and a static vane, the rotating vane and the static vane positioned between an outer casing and an inner casing, the rotating vane and the static vane each having a root region, a tip region, and a pitch region between the tip region and the root region; a first channel having a first end proximate to the tip region of the static vane positioned to capture tip leakage of an operative fluid of the turbo machine from the rotating vane and a second end proximate to the pitch region of the static vane to redirect the tip leakage radially inward from near the tip region to the pitch region; and a second channel having a first end proximate to the root region of the static vane positioned to capture root leakage of the operative fluid of the turbo machine from the rotating vane and a second end proximate to the pitch region of the static vane to redirect the root leakage radially outward from near the root region to the pitch region.

A second aspect of the invention provides a static vane and vane support in a turbo machine, the static vane having a root region, a tip region, and a pitch region between the tip region and the root region, and the vane support having a tip support region and a root support region and support the static vane in an axial direction, the static vane and vane support including: a first channel having a first end proximate to the tip region positioned to capture tip leakage of an operative fluid of the turbo machine from a rotating vane and a second end proximate to the pitch region to redirect the tip leakage radially inward from near the tip region to the pitch region; and a second channel having a first end proximate to the root region positioned to capture root leakage of the operative fluid of the turbo machine from the rotating vane and a second end proximate to the pitch region to redirect the root leakage radially outward from near the root region to the pitch region.

A third aspect of the invention provides a system for a turbo machine, the system comprising: a rotating vane and a static vane, the rotating vane and the static vane positioned between an outer casing and an inner casing, the rotating vane and the static vane each having a root region, a tip region, and a pitch region between the tip region and the root region; and at least one of: (a) a first channel having a first end proximate to the tip region of the static vane positioned to capture tip leakage of an operative fluid of the turbo machine from the rotating vane and a second end proximate to the pitch region of the static vane to redirect the tip leakage radially inward from near the tip region to the pitch region; and (b) a second channel having a first end proximate to the root region of the static vane positioned to capture root leakage of the operative fluid of the turbo machine from the rotating vane and a second end proximate to the pitch region of the static vane to redirect the root leakage radially outward from near the root region to the pitch region.

DETAILED DESCRIPTION OF THE INVENTION

At least one embodiment of the present invention is described below in reference to its application in connection with and operation of a turbo machine in the form of a steam turbine. However, it should be apparent to those skilled in the art and guided by the teachings herein that the present invention is likewise applicable to any suitable turbo machine such as a turbine and/or engine. Embodiments of the present invention provide a system for a turbo machine to improve efficiency.

Figure 1:
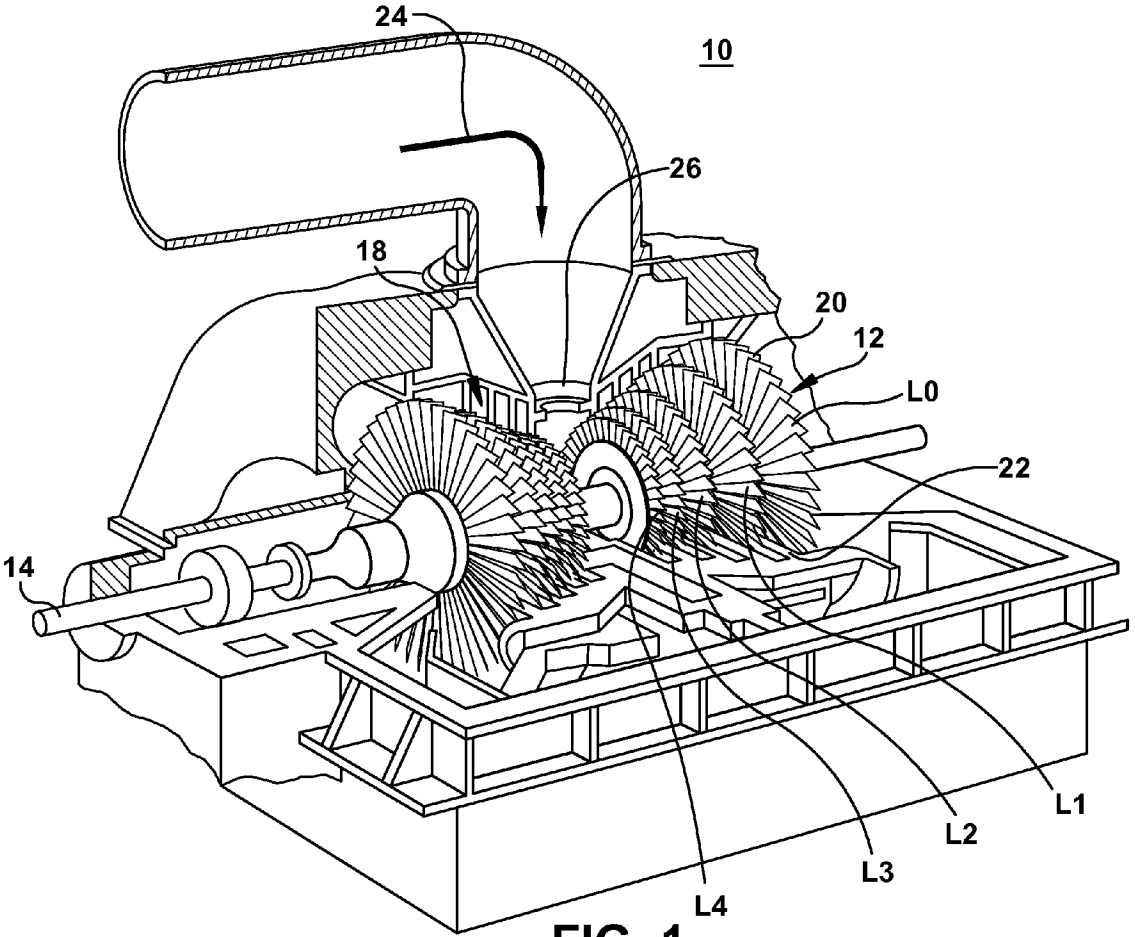
FIG. 1 shows a perspective partial cut-away view of a steam turbine.

Referring to the drawings, FIG. 1 shows a perspective partial cut-away illustration of a steam turbine 10. Steam turbine 10 includes a rotor 12 that includes a rotating shaft 14 and a plurality of axially spaced rotor wheels 18. A plurality of rotating vanes 20 (also referred to as blades 20) are mechanically coupled to each rotor wheel 18. More specifically, blades 20 are arranged in rows that extend circumferentially around each rotor wheel 18. A plurality of stationary vanes 22 extend circumferentially around shaft 14, and vanes 22 are axially positioned between adjacent rows of blades 20. Stationary vanes 22 cooperate with blades 20 to form a stage and to define a portion of a steam flow path through turbine 10.

In operation, operative fluid 24, such as steam, enters an inlet 26 of turbine 10 and is channeled through stationary vanes 22. Vanes 22 direct operative fluid 24 downstream against blades 20. Operative fluid 24 passes through the remaining stages imparting a force on blades 20 causing shaft 14 to rotate. At least one end of turbine 10 may extend axially away from rotor 12 and may be attached to a load or machinery (not shown) such as, but not limited to, a generator, and/or another turbine.

As shown in FIG. 1, turbine 10 comprises at least one stage (five stages are shown in FIG. 1). The five stages are referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). As the operative fluid moves through the various stages, the pressure drops, i.e., the operative fluid is at a higher pressure at stage L4 than at stage L0. It is to be understood that five stages are shown as one example only, and each turbine may have more or less than five stages.

Figure 2:
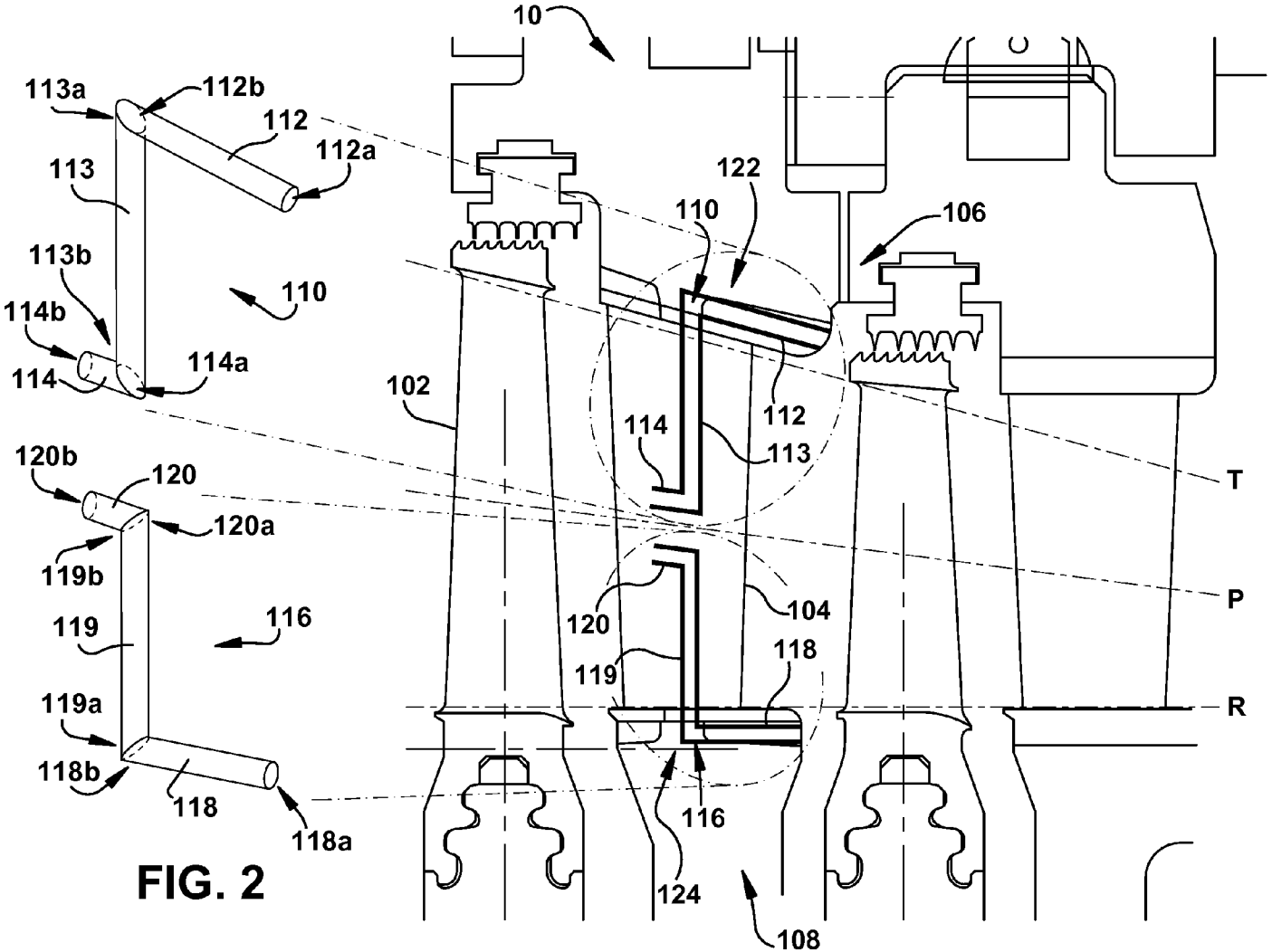
FIG. 2 shows a cross-sectional view of an illustrative stage of a steam turbine according to an embodiment of the invention.

An illustrative stage including a system for a steam turbine 10 according to embodiments of this invention is shown in FIG. 2. FIG. 2 includes a rotating vane 102 and a static vane 104, both positioned between an outer casing 106 and an inner casing 108. Outer casing 106 includes a tip support 122, and inner casing 108 includes a root support 124. Supports 122, 124 collectively support static vane 104 in an axial direction. As illustrated by reference lines R, T and P, rotating vane 102 and static vane 104 each have a root region R, a tip region T, and a pitch region, or middle radial region, P, between tip region T and root region R. In a typical steam turbine, steam may leak through the tip region T and root region R during operation.

In order to redirect high-energy steam that has leaked through tip region T, at least one first channel 110 is provided. First channel 110 can comprise any configuration that will allow the operative fluid to travel from near tip region T to near pitch region P towards rotating vane 102. For example, in one embodiment, shown in FIG. 2, first channel 110 can include a first end 112, a middle portion 113 and a second end 114. As shown in FIG. 2, first end 112 can extend axially and have one end 112*a* open proximate to tip region, T, and one end 112*b* in communication with middle portion 113. Middle portion 113 can extend in the radial direction and have one end 113*a* in communication with first end 112 and one end 113*b* in communication with second end 114. Second end 114 can extend in the axial direction and have one end 114*a* in communication with middle portion 113 and one end 114*b* open proximate to pitch region P. It is understood that any alternative shapes or configuration of first channel 110, such as curved channels, straight line channels, combination of straight lines and curves, etc., is possible in order to achieve the desired redirecting of steam.

Figure 3:
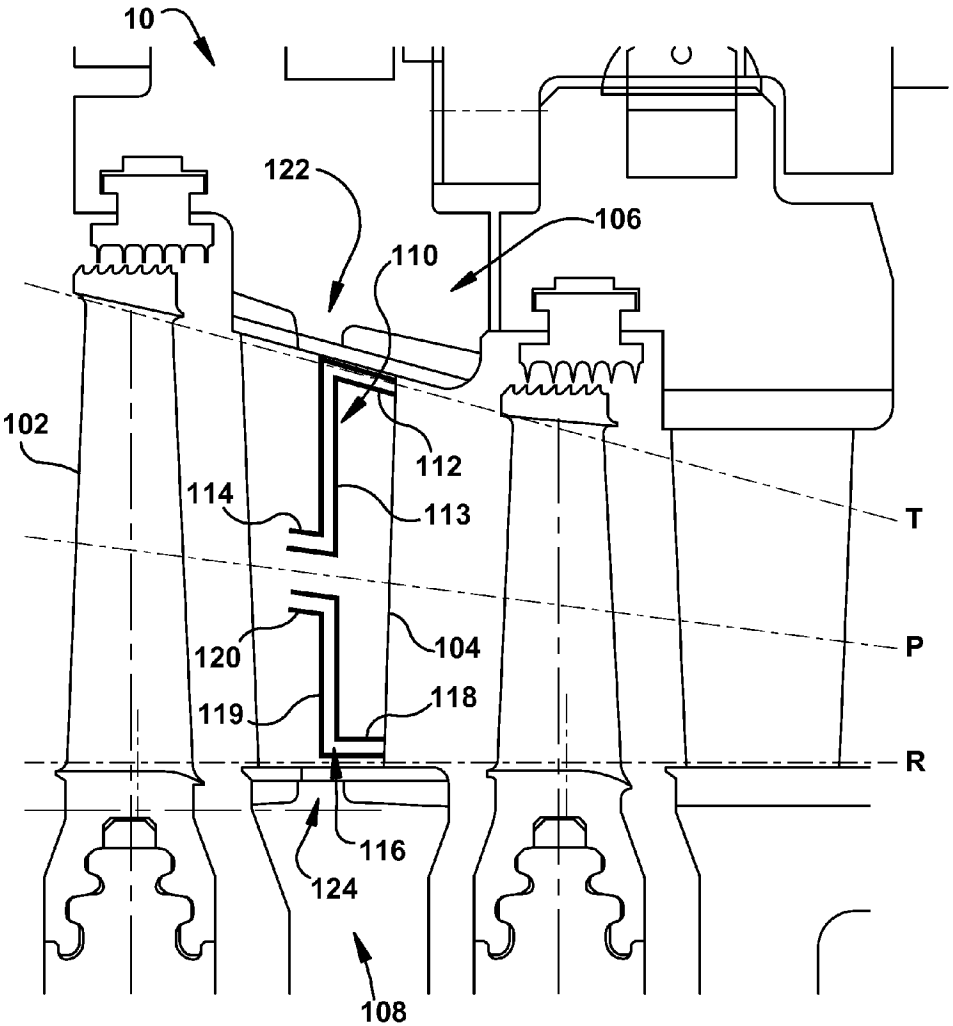
FIG. 3 shows a cross-sectional view of an illustrative stage of a steam turbine according to another embodiment of the invention.

First channel 110 can also be oriented within a stage of turbine 10 as desired. For example, in one embodiment, shown in FIG. 2, a portion of first channel 110 can be disposed within outer casing 106, specifically, first end 112, and a portion of middle portion 113 are disposed within tip support 112 of outer casing 106. In another embodiment, shown in FIG. 3, first channel 110 in its entirety, including first end 112, middle portion 113 and second end 114, can be disposed within static vane 104. It is also understood that alternative positions of first channel 110 are also possible, e.g., first channel 110 could be entirely outside static vane 104, or at least a portion of first end 112 and second end 114 could be outside static vane 104 and not within outer casing 106, in order to achieve the desired redirecting of steam.

Regardless of the shape or configuration of first channel 110, first channel 110 allows tip leakage of an operative fluid of the turbo machine (e.g., high-energy steam leaking through tip region T of static vane 104 of a steam turbine) to travel from near tip region T, through first channel 110, to exit near pitch region P towards rotating vane 102. As such, tip leakage of an operative fluid of the turbo machine is redirected through first channel 110 radially inward from an area of higher pressure near tip region T to an area of lower pressure near pitch region P.

Figure 4:
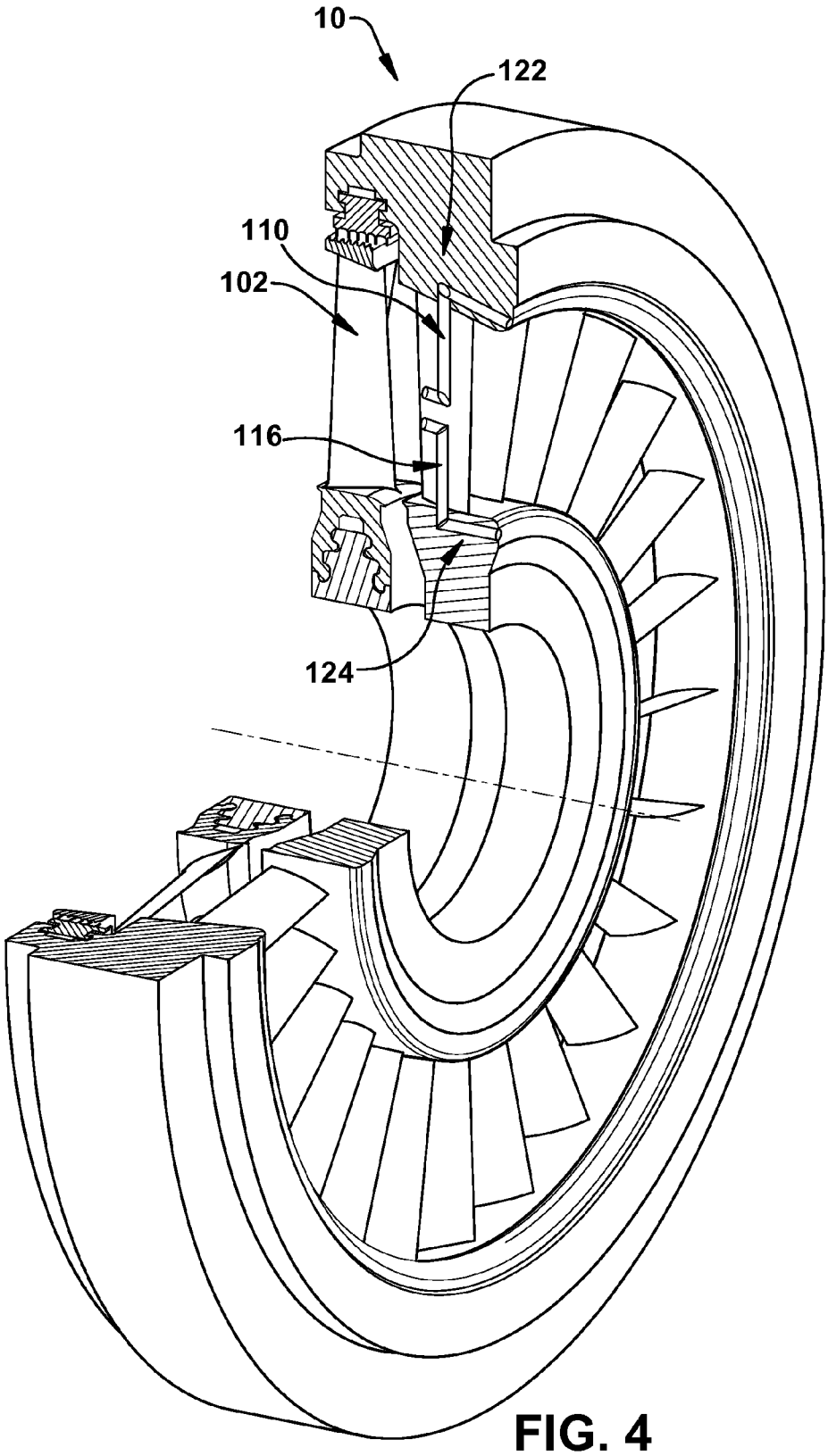
FIG. 4 shows a three-dimensional partial cut-away view of a steam turbine according to embodiments of the invention.

In order to redirect as much tip leakage of the operative fluid as possible, a plurality of first channels 110 can be included, for example, as shown in FIG. 4, four first channels 110 can be positioned approximately 90° from each other about a central axis of the turbine. While four channels 110 are shown in FIG. 4, it is understood that any number of channels 110, positioned as desired around the central axis of the turbine, can be included in accordance with embodiments of this invention.

In order to redirect high-energy steam that has leaked through root region R, at least one second channel 116 is provided. Second channel 116 can comprise any configuration that will allow the operative fluid to travel from near root region R to near pitch region P towards rotating vane 102. For example, in one embodiment, shown in FIG. 2, second channel 116 can include a first end 118, a middle portion 119 and a second end 120. As shown in FIG. 2, first end 118 can extend axially and have one end 118*a* open proximate to root region, R, and one end 118*b* in communication with middle portion 119. Middle portion 119 can extend in the radial direction and have one end 119*a* in communication with first end 118 and one end 119*b* in communication with second end 120. Second end 120 can extend in the axial direction and have one end 120*a* in communication with middle portion 119 and one end 120*b* open proximate to pitch region P. It is understood that any alternative shapes or configuration of second channel 116, such as curved channels, straight line channels, combination of straight lines and curves, etc., is possible in order to achieve the desired redirecting of steam.

Second channel 116 can also be oriented within a stage of turbine 10 as desired. For example, in one embodiment, shown in FIG. 2, a portion of second channel 116 can be disposed within inner casing 108, specifically, first end 118, and a portion of middle portion 119 are disposed within root support 124 of inner casing 108. In another embodiment, shown in FIG. 3, second channel 116 in its entirety, including first end 118, middle portion 119 and second end 120, can be disposed within static vane 104. It is also understood that alternative positions of second channel 116 are also possible, e.g., second channel 116 could be entirely outside static vane 104, or at least a portion of first end 118 and second end 120 could be outside static vane 104 and not within inner casing 108, in order to achieve the desired redirecting of steam.

Regardless of the shape or configuration of second channel 116, second channel 116 allows root leakage of an operative fluid of the turbo machine (e.g., high-energy steam leaking through root region R of static vane 104 of a steam turbine) to travel from near root region R, through second channel 116, to exit near pitch region P towards rotating vane 102. As such, root leakage of an operative fluid of the turbo machine is redirected through second channel 116 radially outward from an area of higher pressure near root region R to an area of lower pressure near pitch region P.

In order to redirect as much root leakage of the operative fluid as possible, a plurality of second channels 116 can be included, for example, as shown in FIG. 4, four second channels 116 can be positioned approximately 90° from each other about a central axis of the turbine. While four channels 116 are shown in FIG. 4, it is understood that any number of channels 116, positioned as desired around the central axis of the turbine, can be included in accordance with embodiments of this invention.

As discussed above, in a conventional steam turbine, leakage through tip region T and root region R results in lower efficiency near those regions, while pitch region R remains at the highest efficiency. According to embodiments of this invention, channels 110, 116 each direct high energy steam flows (i.e. leakages flows of the operative fluid) such that the high energy steam mixes with the high efficiency main steam flow at pitch region P where efficiency is the highest. Because both channels 110, 116 end at pitch region P near static vane 104, this high-energy steam is optimally redirected such that rotating vane 102 can capture most of its energy and increase stage efficiency. This results in a significant performance improvement for the turbine that evens out the efficiency profile resulting in higher average efficiencies.

While embodiments of this invention have been discussed with regard to a single stage of a steam turbine, it is understood that channels 110, 116 can be provided in multiple stages as well. It is also understood that any stage could include both first and second channels 110, 116 or only first channel 110 or only second channel 116. It is also understood that while embodiments of this invention have been discussed in connection with a steam turbine, embodiments of this invention could also be utilized in any suitable turbo machine.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 wt %, or, more specifically, about 5 wt % to about 20 wt %", is inclusive of the endpoints and all intermediate values of the ranges of "about 5 wt % to about 25 wt %," etc).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for a turbo machine, the system comprising:

a rotating vane and a static vane, the rotating vane and the static vane positioned between an outer casing and an inner casing, the rotating vane and the static vane each having a root region, a tip region, and a pitch region between the tip region and the root region;

a first channel having a first end proximate to the tip region of the static vane positioned to capture tip leakage of an operative fluid of the turbo machine from the rotating vane and a second end proximate to the pitch region of the static vane to redirect the tip leakage radially inward from near the tip region to the pitch region; and a second channel having a first end proximate to the root region of the static vane positioned to capture root leakage of the operative fluid of the turbo machine from the rotating vane and a second end proximate to the pitch region of the static vane to redirect the root leakage radially outward from near the root region to the pitch region, wherein one of the first channel or the second channel is disposed entirely within the static vane.

2. The system of claim 1, wherein the first channel is disposed entirely within the static vane, and wherein the first end of the second channel is disposed within the inner casing, and the second end of the second channel is disposed within the static vane.

3. The system of claim 1, wherein the second channel is disposed entirely within the static vane, and wherein the first end of the first channel is disposed within the outer casing, and the second end of the first channel is disposed within the static vane.

4. The system of claim 1, wherein the operative fluid of the turbo machine is redirected from an area of higher pressure to an area of lower pressure.

5. A static vane and vane support in a turbo machine, the static vane having a root region, a tip region, and a pitch region between the tip region and the root region, and the vane support having a tip support region and a root support region and support the static vane in an axial direction, the static vane and vane support including:

a first channel having a first end proximate to the tip region positioned to capture tip leakage of an operative fluid of the turbo machine from a rotating vane and a second end proximate to the pitch region to redirect the tip leakage radially inward from near the tip region to the pitch region; and a second channel having a first end proximate to the root region positioned to capture root leakage of the operative fluid of the turbo machine from the rotating vane and a second end proximate to the pitch region to redirect the root leakage radially outward from near the root region to the pitch region, wherein one of the first channel or the second channel is disposed entirely within the static vane.

6. The static vane and vane support of claim 5, wherein the first channel is disposed entirely within the static vane, wherein the first end of the second channel is disposed within the root support region, and the second end of the second channel is disposed within the static vane.

7. The static vane and vane support of claim 5, wherein the second channel is disposed entirely within the static vane and wherein the first end of the first channel is disposed within the tip support region, and the second end of the first channel is disposed within the static vane.

8. The static vane of claim 5, wherein the operative fluid of the turbo machine is redirected from an area of higher pressure to an area of lower pressure.

* * * * *